US006161410A

United States Patent [19]

Shook et al.

[11] Patent Number: 6,161,410

[45] Date of Patent: Dec. 19, 2000

[54] MULTI-AXIS ROLLER HEMMER

[75] Inventors: John B. Shook, Madison Heights, Mich.; Philip V. Wiens, LaSalle, Canada

[73] Assignee: Unova IP Corp., Woodland Hills, Calif.

[21] Appl. No.: 09/132,577

[22] Filed: Aug. 11, 1998

[51] Int. Cl.[7] ..... B21D 7/02

[52] U.S. Cl. ..... 72/220

[58] Field of Search ..... 72/214, 215, 210, 72/220, 211; 29/243.5, 243.57, 243.58

[56] References Cited

U.S. PATENT DOCUMENTS

| | | | |
|---|---|---|---|
| 709,754 | 9/1902 | Ditchfield . | |
| 3,522,784 | 8/1970 | Moxley, Sr. | 113/55 |
| 4,472,867 | 9/1984 | Wivinis | 29/243.5 |
| 4,538,334 | 9/1985 | Binggeli | 29/243.5 |
| 5,224,253 | 7/1993 | Sawa | 29/243.58 |
| 5,228,190 | 7/1993 | Sawa | 29/715 |
| 5,267,387 | 12/1993 | Sawa | 29/509 |
| 5,507,165 | 4/1996 | Hartley | 72/311 |
| 5,623,805 | 4/1997 | Morello | 52/749.1 |
| 5,784,915 | 7/1998 | Allemann et al. | 72/211 |

*Primary Examiner*—Rodney Butler

*Attorney, Agent, or Firm*—Reising, Ethington, Barnes, Kisselle, Learman & McCulloch, P.C.

[57] ABSTRACT

A multi-axis roller hemmer for forming at least a pre-hem of a flange area of a sheet metal panel having a roller engageable with the flange and movable about at least 3 axes to enable the roller to remain in contact with the flange along a substantial portion of the panel. Preferably, the apparatus is capable of varying the position of the roller along orthogonal X-Y-Z axes to enable the apparatus to form at least a pre-hem of more intricate, curved panels. Desirably, the roller may also be pivotally displaced to vary the relative angle between the roller axis of rotation and the panel to maintain the roller axis essentially parallel to the immediately underlying portion of the panels. Preferably, at least a pair of rollers are carried by the apparatus with one or more rollers forming a pre-hem of the flange and a final hem roller constructed to complete the hem of the flange area.

24 Claims, 3 Drawing Sheets

MULTI-AXIS ROLLER HEMMER

FIELD OF THE INVENTION

This invention relates generally to the hemming of sheet metal panels, and more particularly to an improved roller hemmer for forming at least a pre-hem on an edge of a sheet metal panel.

BACKGROUND OF THE INVENTION

It is well known to construct motor vehicle body doors, hoods, fenders, tailgates, trunk and deck lids by stamping an outer sheet metal panel and separately stamping an inner sheet metal reinforcing panel with an outer periphery generally matching that of the outer panel, and then joining the two panels together by hemming a flange of the periphery of the outer panel over an adjacent edge of the inner panel to secure the panels together. Desirably, the outer panel is slightly larger than the inner panel to provide a border flange portion along the periphery of the outer panel which preferably has an upstanding lip which can be folded over the peripheral edge of the inner panel to define the hem flange which connects the two panels.

Generally, to form the hem flange, a force of approximately 1,000 pounds per lineal inch is required. Thus, to form a hem flange about an elongate portion of a panel, a very large force is required. To withstand and accurately apply these large hemming forces, prior hemming machines have been large in size. So-called roller hemming machines utilize relative motion between a roller and the sheet metal panel to be hemmed to form the hem. The roller forms a hem about only a small portion of the sheet metal panel at any given moment, and thus, the force which the roller must apply to the panel to form the hem is greatly reduced. The reduced force enables the hem to be formed by more compact, more versatile and less costly hemming machines. Previous roller hemming machines generally have one or more rollers fixed on a frame or spring biased relative to the part on which the hem is to be formed. Thus, the roller hemmers provide a movement between the roller and the part to be formed in a first direction generally coincident with the edge of the part to be formed and possibly in a second direction generally in the direction of the spring biasing the roller. While satisfactory for generally straight, linear edges of a part, these previous roller hemming machines are not able to form a hem about more intricate parts having multiple curves such as sheet metal panels forming the doors, hood, trunk and deck lids and the like of modern vehicles.

One prior hemming apparatus, such as disclosed in U.S. Pat. No. 5,507,165, provides a tapered roller for pre-hemming the flange area of a panel which is carried by an arm pivotally connected to a slide and having a cam follower which engages a cam surface to pivot the arm so that the roller moves along a path substantially parallel to the flange. This hemming apparatus thus provides a compound movement of the roller in the general direction of the movement of the slide as well as in a direction dictated by the contour of the cam surface to form a pre-hem along the desired portion of the panel. Although useful for pre-hemming the flange of many parts, this hemming apparatus provides only a limited compound movement in a single plane which is insufficient to form a pre-hem of a flange about more intricate automobile body panels with peripheral edge portions having a compound curve.

SUMMARY OF THE INVENTION

A multi-axis roller hemmer for forming at least a pre-hem of a flange area having a compound curve of a sheet metal panel having a roller engageable with the flange and movable about at least 3 axes to enable the roller to remain in contact with the compound curve flange area along a substantial portion of the panel. Preferably, the apparatus is capable of varying the position of the roller along the orthogonal X-Y-Z axes to enable the apparatus to form at least a pre-hem of more intricate, curved panels. Desirably, the roller may also be pivotally displaced to vary the relative angle between the roller and the panel to maintain the roller generally perpendicular to the flange of the panel along portions which are curved generally inwardly or outwardly relative to the apparatus. Preferably, at least a pair of rollers are carried by the apparatus with one or more rollers forming a pre-hem of the flange and a final roller constructed to complete the final hem of the flange area.

Preferably, the entire apparatus moves parallel to a plane containing the X-axis to vary the position of the roller relative to the panel along the X-axis. A first follower received in a first cam track displaces a portion of the apparatus parallel to a plane containing the Y-axis to vary the position of the roller relative to the panel along the Y-axis as the entire apparatus is also moved generally parallel to the X-axis. A second follower received in a second cam track displaces a portion of the apparatus in a plane generally parallel to a plane containing the Z-axis to vary the position of the roller generally along the Z-axis. In a preferred embodiment, the roller is carried by an arm pivotally connected to the apparatus for pivotal movement of the roller in response to movement of a third follower relative to a third cam. Thus, the roller forming the hem about the panel is movable in at least the X, Y and Z axes and also preferably movable about a pivotal axis to enable the roller to form a hem about even an intricate, compound curved portion of the panel.

Desirably, the entire apparatus is moved by an actuator along one or more ways extending parallel to the X-axis. The actuator may be of substantially any form including, but not limited to an electric motor, hydraulic cylinder, pneumatic cylinder, manual crank, manual lever or other powered or manual means suitable to move the entire apparatus forward and back along the ways. The electric motor or manual actuator options may be desirable when a low cost hemming apparatus is desired and are possible because of the relatively small area of the panel which is being hemmed at any moment by the roller such that a relatively small force applied to a roller will sufficiently hem the panel. The smaller hemming force facilities movement of the roller along the X, Y and Z axes as well as along the pivotal axis. Further, the smaller hemming force permits a small, compact and versatile hemming apparatus.

Objects, features and advantages of this invention include providing a hemming apparatus to form at least an initial pre-hem of a flange area of a panel which is extremely versatile, requires a relatively small force to form the hem, may provide a pre-hem and a finished hem in a single apparatus, can form a hem of a relatively intricate, compound curved panel, is controlled by a single actuator, may be manually, electrically, hydraulically or pneumatically driven, is readily adjustable, has a plurality of interchangeable cam tracks or cams to facilitate forming a hem on different panels, is of relatively simple design, economical manufacture and assembly and has a long, useful life.

BRIEF DESCRIPTION OF THE DRAWINGS

These and other objects, features and advantages of this invention will be apparent from the following detailed description of the preferred embodiments and best mode, appended claims and accompanying drawings in which:

DETAILED DESCRIPTION OF THE PREFERRED EMBODIMENTS

Figure 1:
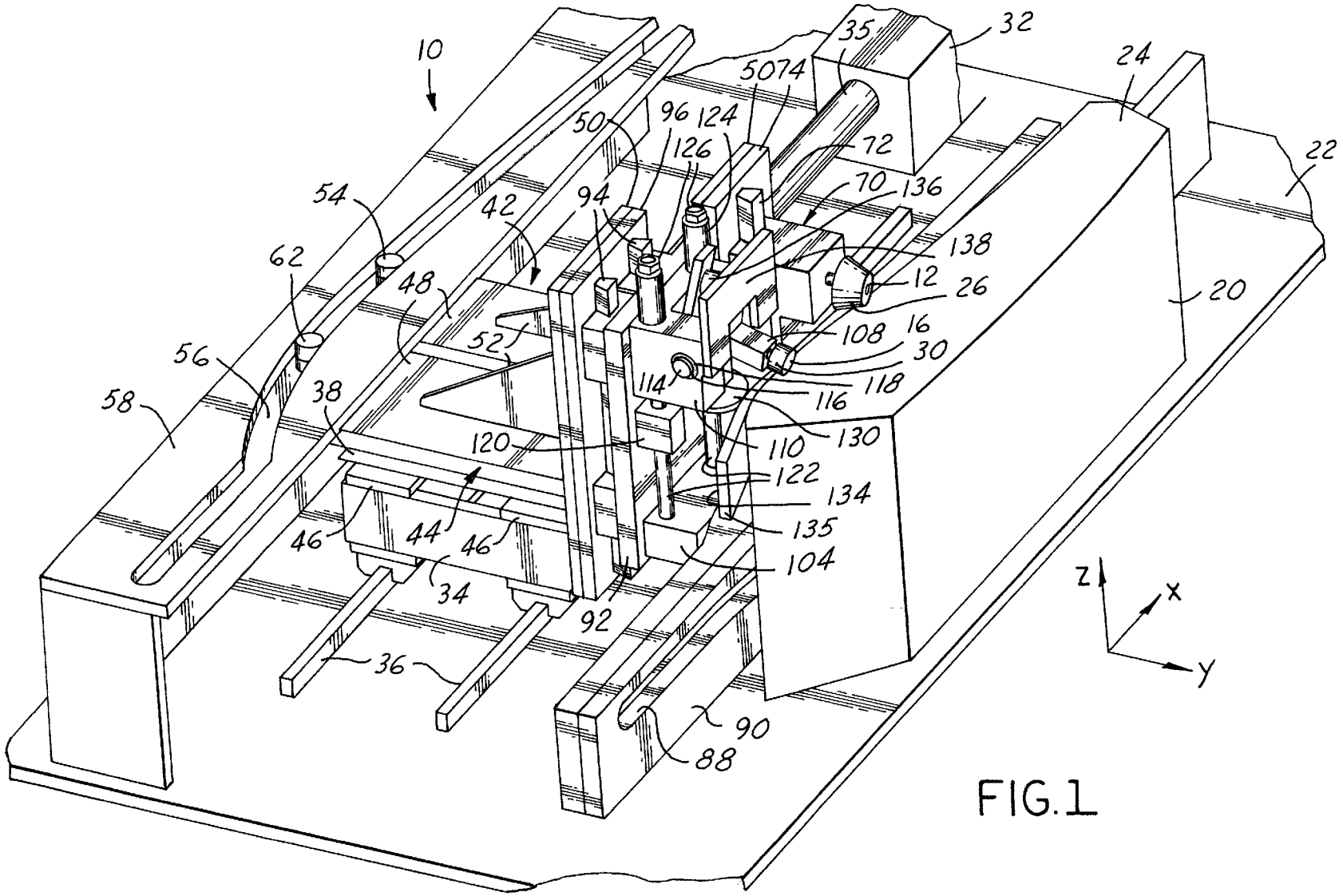
FIG. 1 is a perspective view of a hemming apparatus embodying the present invention.

Referring in more detail to the drawings, FIGS. 1–4 illustrate a hemming apparatus 10 according to a preferred embodiment of this invention and having a pre-hem roller 12 to "pre-hem" or initially bend a flange 13 of an outer sheet metal panel 14 and a final roller 16 constructed to "final hem" or complete the hemming of the flange 13' of the outer panel 14 onto an inner panel 18 to secure the panels together. Typical sheet metal panels 14, 18 are used for motor vehicle body doors, hoods, trunk and deck lids. The inner panel 18 is nested within the outer panel 14 and they are received on a fixture with the portion of the panels to be hemmed received on an anvil die 20 itself received on a bed 22 of the apparatus 10. Desirably, the face 24 of the anvil 20 adjacent the sheet metal panels 14, 18 is contoured generally complimentary to the sheet metal panels to provide adequate support to the panels along substantial the entire portion to be hemmed.

Generally, the hemming apparatus has a carriage 34 driven for reciprocation by an actuator 32 and on which several cross-slide assemblies 42, 44, 70, 92 are received. Movement of the cross-slide assemblies 42, 44, 70, 92 is controlled by various followers 54, 62, 82, 98 responsive to the profiles of various cam tracks 56, 88 to translate the linear movement of the carriage 34 into a compound non-linear movement of the rollers 12 and 16 to form a flange about a desired portion of even curved sheet metal panels 14, 18.

The pre-hem roller 12 is disposed upstream or ahead of the final roller 16 to initially bend or pre-hem the flange. As shown, the pre-hem roller 12 has a truncated cone shape providing an inclined, peripheral forming face 26 suitable to bend the flange from an initial included angle of about 90° to 100° to an acute included angle of about 60° to 30° relative to the sheet metal panels. Desirably, if the initial angle of the flange is greater than 100° or so, a second pre-hem roller 28 (shown in phantom in FIG. 2) may be provided upstream or ahead of the pre-hem roller 12 to initially bend the flange to a suitable angle for subsequent bending by the pre-hem roller 12.

The final roller 16 is preferably generally cylindrical in shape providing a generally flat, peripheral forming face 30 suitable to flatten or finish the bending of the flange. Desirably, the final roller 16 is relatively small and engages only a limited portion of the flange at any given moment to enable a finished hem to be formed with a relatively low force applied to the final roller 16.

Figure 2:
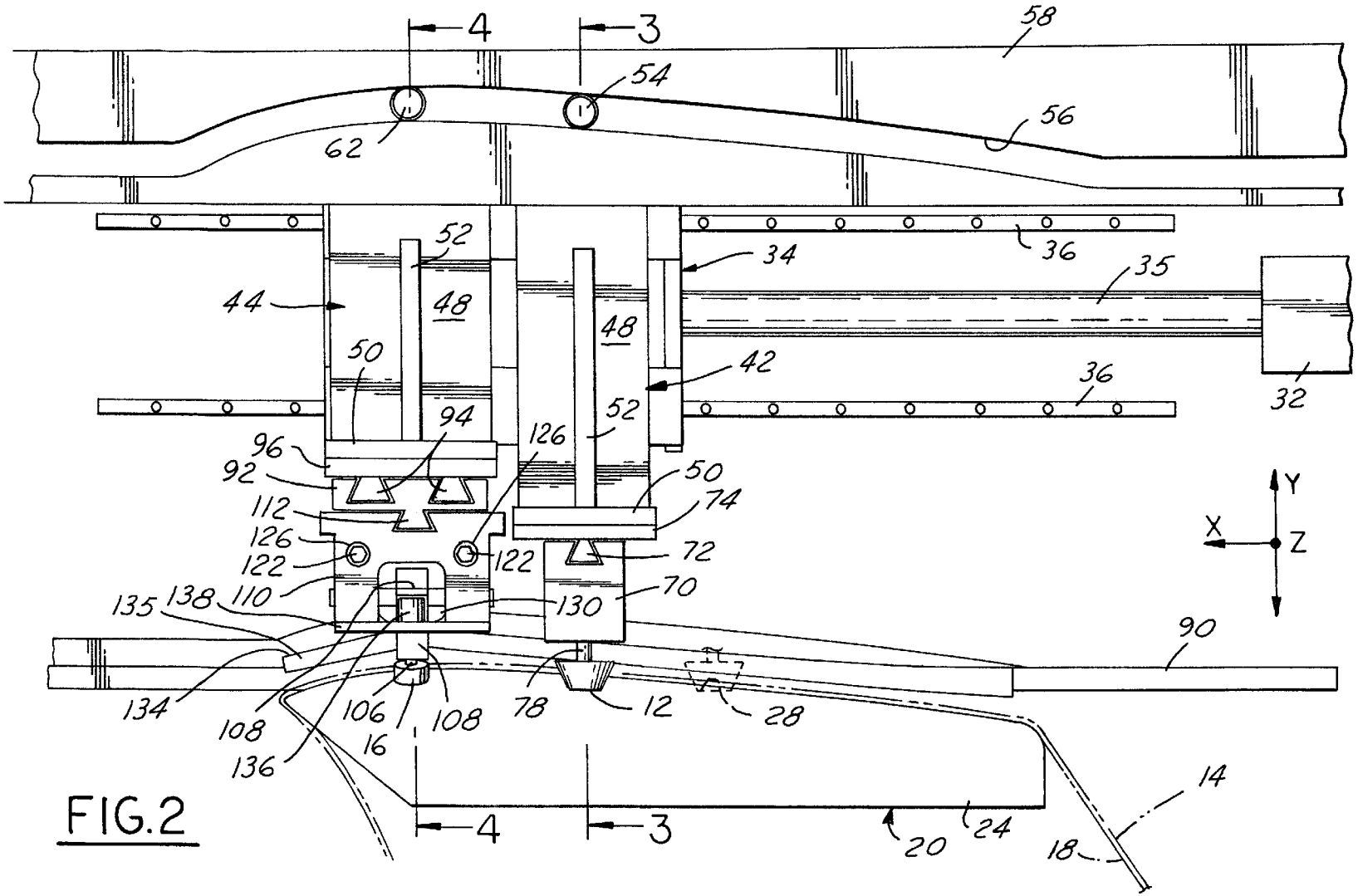
FIG. 2 is a top view of the hemming apparatus of FIG. 1.

As shown in FIGS. 1 and 2, the hemming apparatus 10 has an actuator 32 which drives a carriage 34 via an actuating rod 35 along a pair of elongate, spaced apart, parallel ways 36 carried on the bed 22. The actuator may be of substantially any form including, but not limited to an electric motor, hydraulic cylinder, pneumatic cylinder, ball and screw drive, crank lever or other powered or manual means suitable to move the entire apparatus forward and back along the ways. A carrier plate 38 attached to the carriage 34 has a first cross slide assembly 42 operably connected to the pre-hem roller 12 and a second cross slide assembly 44 operably connected to the final roller 16 and each slidably received on a separate way or key 40. The ways or keys 40 are preferably spaced apart, essentially parallel and extend transversely to the ways 36 on which the carriage 34 moves. Preferably the position of the carrier plate 38 relative to the carriage 34 may be readily adjusted such as by one or more spacers or shims 46 received between them. The first and second cross slide assemblies 42, 44 are independently movable relative to the carrier plate 38 with each having a separate base plate 48 and connected to an upright 50 with one or more generally triangular reinforcing plates or gussets 52 fixed between the base 48 and upright 50.

The movement of the first cross slide assembly 42 is controlled by a first follower 54 received in a contoured cam track 56 of a first cam plate 58. The first cam plate 58 and its track 56 are elongate and preferably extend generally parallel to the ways 36 and along substantially the entire length of the portion of the panels 14, 18 being hemmed. The cam track 56 has a pre-defined profile or contour designed for a particular set of sheet metal panels 14, 18. As shown, the first follower 54 is rotatably journalled on one end of a shaft 60 which is fixed at its other end to the base plate 48 of the first cross slide assembly 42. Similarly, the movement of the second cross slide assembly 44 is controlled by a second follower 62 also received in the cam track 56 of the first cam plate 58. The second follower 62 is rotatably journalled on one end of a shaft 64 which has its other end fixed to the base plate 48 of the second cross slide assembly 44.

Figure 3:
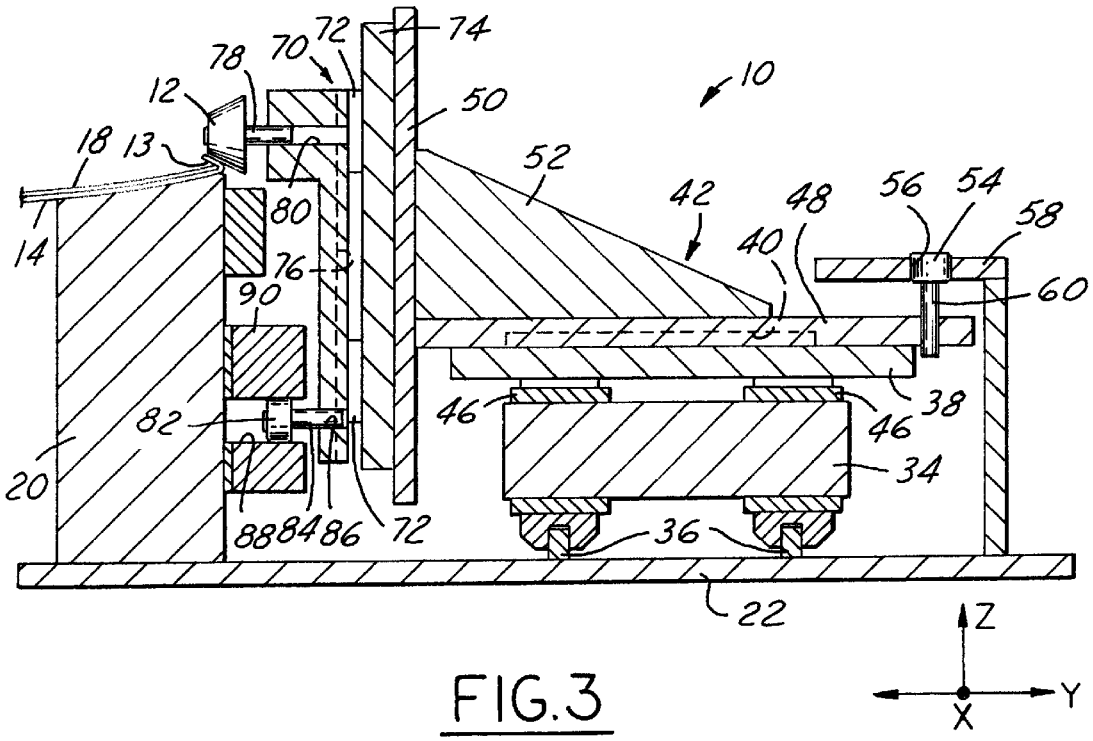
FIG. 3 is a cross sectional view taken along the line 3—3 of FIG. 2.

As shown in FIGS. 2 and 3, a third cross slide 70 is preferably received on one or more ways or keys 72 secured to a mounting plate 74 bolted or otherwise fixed to the upright 50 of the first cross slide assembly 42. Preferably, the keys 72 are generally dovetail shaped in cross section and are received in complimentary slots 76 in the third cross slide 70. The pre-hem roller 12 is rotatably journalled on one end of a shaft 78 which has its other end received in a bore 80 of the third cross slide 70. A third follower 82 is rotatably journalled on one end of another shaft 84 which has its other end received in a separate bore 86 in the third cross slide 70. The third follower 82 is received in a cam track 88 of a second cam plate 90 preferably releasably secured to the die anvil 20. Alternatively, the cam track 88 may be formed directly in the die anvil 20, although a removable cam plate facilitates replacement of a worn cam and interchanging of cam plates with cam tracks constructed to form different parts. The second cam plate 90 and its track 88 extend generally parallel to the ways 36 and along substantially the entire length of the portion of the panels 14, 18 being hemmed. The cam track 88 has a predefined profile or contour designed for use with a particular set of sheet metal panels 14, 18.

Figure 4:
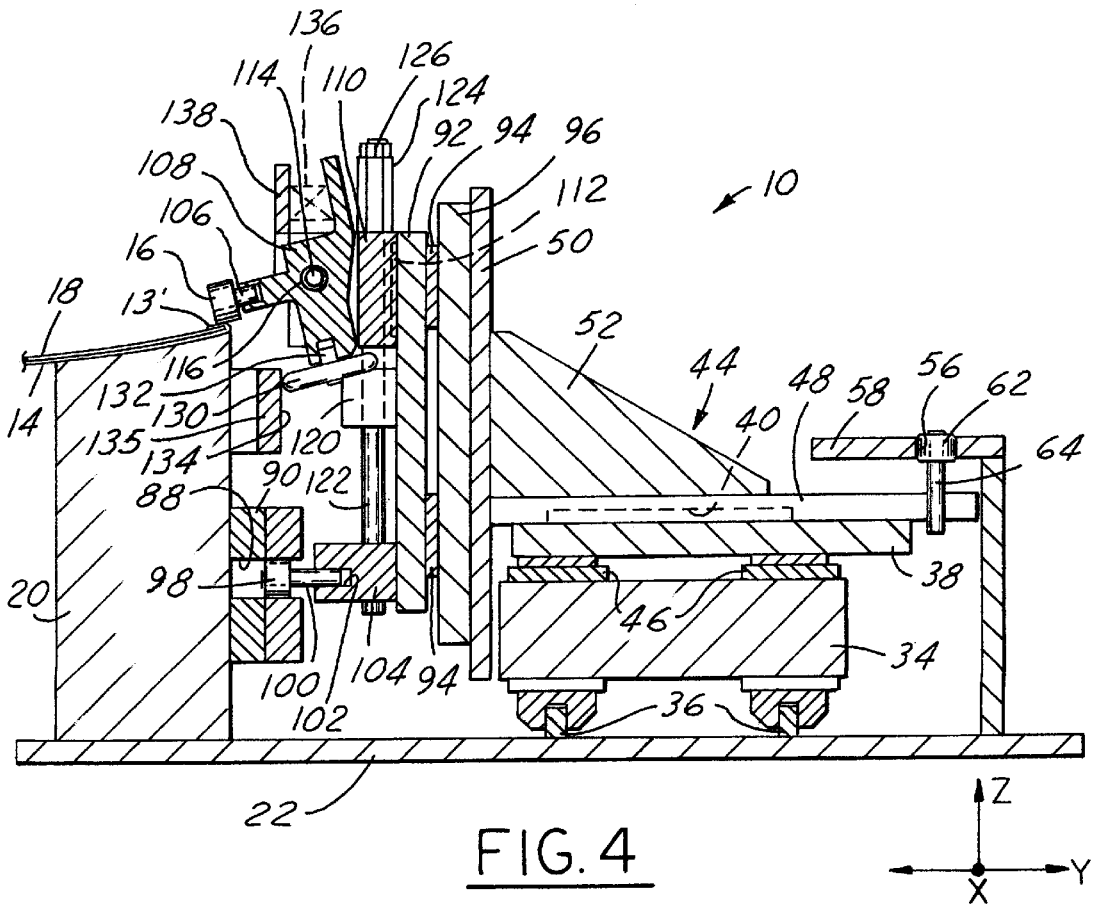
FIG. 4 is a cross sectional view taken along the line 4—4 of FIG. 2.

As shown in FIGS. 2 and 4, a fourth cross slide 92 is slidably carried on another pair of dovetail ways or keys 94 of a mounting plate 96 which are disposed generally parallel to the keys 72 associated with the third cross slide 70. Movement of the fourth cross slide 92 is controlled by a fourth follower 98 also received in the cam track 88 of the second cam plate 90. The fourth follower 98 is rotatably journalled on one end of a shaft 100 which has its other end received in a bore 102 of an extension 104 of the fourth cross slide 92. The final hem roller 16 is journalled on one end of a shaft 106 which has its other end fixed to a carrier body 108 which is pivotally connected to a slide 110 itself carried on a dovetail way or key 112 of the fourth cross slide 92. Preferably, the carrier body 108 is pivotally mounted on the slide 110 by a pin 114 extending through the carrier body 108 and journalled in bushings 116 received in openings 118 through the slide 110. The slide 110, and hence the final roller 16, is yieldably biased downwardly toward the sheet metal panels 14, 18 to form the hem by springs 124 received over shafts 122 between the slide 110 and a nut 126 on one end of each shaft 122. Each shaft 122 is slidably received through the slide 110 and fixed to the extension 104 of the fourth cross slide 92. Relative movement between the slide 110 and the fourth cross slide 72 is limited by a stop 120 fixed to the shaft 122. The slide 110 is movable relative to the fourth cross slide 92 and permits the final hem roller 16 to be responsive to slight deviations within a panel or between different panels. Movement of the slide 110 is limited by the stop 120 in one direction and is restricted in the other direction by the force of the springs 124.

A fifth follower 130 is journalled on one end of a shaft 132 which is fixed at its other end to the carrier body 108 and is responsive to changes in the predefined profile or contour of a third cam surface 134 of a cam plate 135 to control the pivotal movement of the final hem roller 16. Preferably, a spring 136 received between the carrier body 108 and a plate 138 on the slide 110 yieldably biases the fifth follower 130 into engagement with the third cam surface 134 and maintains them in substantially continuous contact. If desired, the pre-hem roller 12 may also be pivotally carried by another slide arrangement (not shown) responsive to the profile of the third cam as described above for the final roller 16. However, it is currently believed that this is not necessary because the pre-hem roller 12 only provides an initial bend to the flange and has an inclined forming face 26 which will form the flange similarly along its entire face 26 regardless of where the flange contacts the face 26.

Operation

To form a pre-hem and a final hem along a substantially continuous, elongate portion of a pair of sheet metal panels 14, 18, the carriage 34 is driven by the actuator 32 to move linearly along the ways 36 generally parallel to an X-axis from a first position to a second position. After the final hem is formed along the desired portion of the panels 14, 18, the actuator 32 returns the carriage 34 to the first position. As the carriage 34 is driven along the ways 36 in a fixed direction generally parallel to the X-axis, the first follower 54 and the second follower 62 are displaced within the cam track 56 of the first cam 58 generally in the direction of the X-axis and are also displaced by the changing contour of the cam track 56 to move the first and second cross slide assemblies 42, 44, respectively, in a plane containing the Y-axis. In other words, the movement of the first and second cross slide assemblies 42, 44 has two components. The first component comprises movement generally parallel to the X-axis corresponding to the movement of the carriage 34. The second component comprises movement along the Y-axis generally transverse to the X-axis, along the keys 40 extending from the platform 38 and controlled by the movement of the first and second followers 54, 62 within the cam track 56. This compound movement provides a compound movement of the pre-hem roller 12 and final hem roller 16 to hem a substantially continuous portion of the flange of the outer sheet metal panel 14 which extends generally parallel to the X-axis and which may have curved portions which deviate towards and away from the carriage 34 generally along the Y-axis.

The third and the fourth cross slides 70, 92 move both in the direction of the X-axis, as driven by the carriage 34 and in the Y-axis as driven by the first and second cross slide assemblies 42, 44, respectively. Additionally, both the third follower 82 and fourth follower 98 are displaced by the changing contour of the track 88 of the second cam 90 generally along the Z-axis to likewise displace the third and fourth cross slides 70, 92, respectively, relative to the Z-axis. Thus, both the pre-hem roller 12 and the final hem roller 16, which are carried by the third and fourth cross slides 70, 92 respectively, have components of movement in the X, Y and Z orthogonal axes. Such a compound movement is achieved with linear movement of the carriage 34 and the contoured cam tracks 56, 88 each designed for a particular part being hemmed. Ideally, the cam plates 58 and 90 can be interchanged to provide different cam track profiles suitable to form a hem of a differently shaped panel. This three-axis compound movement of both the pre-hem roller 12 and the final hem roller 16 facilitates forming a substantially complete hem about a substantially continuous portion of compound curved or contoured sheet metal panels.

Additionally, the final hem roller 16 is pivoted about an axis perpendicular to its axis of rotation to change the angular orientation of the final roller 16 to maintain the forming face 30 of the final roller 16 essentially parallel to the underlying portion of the sheet metal panels 14, 18. This pivotal movement is imparted by the fifth follower 130 which is responsive to the profile of the third cam 134 and facilities forming the flange about a portion of the sheet metal panels 14, 18 which is slightly curled or canted inwardly or outwardly relative to the apparatus 10.

Thus, the hemming apparatus 10 provides both a pre-hem and a final hem of a flange of a sheet metal panel which extends generally along the X-axis and which is curved or otherwise significantly contoured. The apparatus 10 provides for movement of both the pre-hem roller 12 and the final hem roller 16 relative to each of the X, Y and Z orthogonal axes and also advantageously enables pivotal movement of at least the final roller 16 to maintain the desired orientation of that roller 16 relative to the sheet metal panels 14, 18. Because the final roller 16 engages a very limited portion of the flange at any given time, a relatively low force may be used to form the hem and the entire apparatus 10 may be extremely compact while still having sufficient structural integrity and rigidity to form the flange. The relatively small hemming force required may be applied through one or more springs 124 which provides yieldably biased final hem rollers to accommodate slight variations between sheet metal panels. The relatively low hemming force and the compact nature of the apparatus 10 according to this invention enables a wide range of actuators 32 to be used such as hydraulic, electric, pneumatic and even manual actuators if an extremely low cost hemming apparatus 10 is desired. In any event, in a single pass of the rollers 12, 16 relative to the panels 14, 18, the hemming apparatus 10 forms both a pre-hem and a complete final hem with a smooth and fair fold line along an elongate and continuous portion of a pair of sheet metal panels 14, 18.

What is claimed is:

1. A device for hemming a flange of a panel comprising:

a carriage;

an actuator which drives the carriage for reciprocation between first and second positions;

a first slide carried by the carriage and slidably displaceable relative to the carriage;

a first cam having a predefined profile;

a first follower carried by the first slide in engagement with the first cam to slidably displace the first slide relative to the carriage in response to the profile of the first cam;

a second slide carried by the first slide and slidably displaceable relative to the first slide;

a second cam having a predefined profile;

a second follower carried by the second slide in engagement with the second cam to slidably displace the second slide relative to the first slide in response to the profile of the second cam;

a roller carried by the second slide for co-movement therewith whereby the movement of the carriage by the actuator moves the first follower relative to the first cam to control the movement of the first slide relative to the carriage and moves the second follower relative to the second cam to control the movement of the second slide and movement of each of the carriage, first slide and second slide cause associated movement of the roller so that the roller can form at least a pre-hem of a substantially continuous portion of the flange of the panel.

2. The device of claim 1 wherein the carriage moves along a first axis generally parallel to the flange and the first slide moves relative to the carriage along a second axis inclined from the first axis.

3. The device of claim 1 wherein the actuator is a manually driven mechanical device.

4. The device of claim 1 wherein the roller has a truncated cone shape to initially and partially bend the flange to form a pre-hem of the flange.

5. The device of claim 1 which also comprises a third slide carried by the carriage and slidably displaceable relative to the carriage generally parallel to the first slide, a fourth slide slidably carried by the third slide for movement relative to the third slide, a third follower carried by the third slide in engagement with the first cam to slidably displace the third slide relative to the carriage in response to the profile of the first cam, a fourth follower carried by the fourth slide in engagement with the second cam to slidably displace the fourth slide relative to the third slide in response to the profile of the second cam, and a second roller carried by the fourth slide and constructed to form a substantially complete or final hem of the flange of the panel.

6. The device of claim 1 wherein the roller bends the flange to an acute included angle of about between 60° and 30° relative to the panel.

7. The device of claim 2 wherein the second axis is generally transverse to the first axis.

8. The device of claim 2 wherein the second slide moves along a third axis inclined from both the first axis and the second axis.

9. The device of claim 7 wherein the first axis is parallel to the X-axis and the second axis is parallel to the Y-axis.

10. The device of claim 7 wherein the first axis is parallel to the X-axis and the second axis is parallel to the Z-axis.

11. The device of claim 8 wherein the third axis is generally transverse to both the first axis and the second axis.

12. The device of claim 5 wherein the second roller has a generally cylindrical shape.

13. A device for hemming a flange of a panel comprising:

a carriage;

a guide which limits the movement of the carriage;

an actuator which drives the carriage along the guide for reciprocation between first and second positions;

a first slide carried by the carriage and slidably displaceable relative to the carriage;

a first cam having a predefined profile;

a first follower carried by the first slide in engagement with the first cam to slidably displace the first slide relative to the carriage in response to the profile of the first cam;

a second slide slidably carried by the first slide for movement relative to the first slide;

a second cam having a predefined profile;

a second follower carried by the second slide in engagement with the second cam to slidably displace the second slide relative to the first slide in response to the profile of the second cam;

a roller having an axis of rotation and pivotally carried by the second slide for angular movement of the roller axis of rotation relative to the second slide to accommodate changes in the contour of the panel whereby the movement of the carriage by the actuator moves the first follower relative to the first cam to control the movement of the first slide relative to the carriage and moves the second follower relative to the second cam to control the movement of the second slide and movement of each of the carriage, first slide and second slide cause associated movement of the roller which may also pivot relative to the second slide so that the roller can form at least a pre-hem of a substantially continuous portion of the flange of the panel.

14. The device of claim 13 wherein the roller pivots about an axis generally perpendicular to its axis of rotation.

15. The device of claim 13 which also comprises a third cam having a predetermined profile and a third follower operably connected to the roller and responsive to the profile of the third cam to control the pivotal movement of the roller.

16. A device for hemming a flange of a panel comprising:

a carriage;

an actuator which drives the carriage between first and second positions;

a first slide carried by the carriage and slidably displaceable relative to the carriage;

a first cam having a predetermined profile;

a first follower carried by the first slide in engagement with the first cam to slidably displace the first slide relative to the carriage in response to the profile of the first cam;

a roller having an axis of rotation and pivotally carried by the first slide for angular movement of the roller axis of rotation relative to the first slide to accommodate changes in the contour of the panel whereby movement of the carriage by the actuator moves both the roller relative to the panel and the first follower relative to the first cam which controls the displacement of the first slide relative to the carriage and causes a corresponding displacement of the roller to form at least a pre-hem of a substantially continuous portion of the panels, the carriage being movable along a first axis generally parallel to the flange of the panel and the first slide being movable relative to the carriage along a second axis inclined from the first axis.

17. The device of claim 16 wherein the second axis is generally transverse to the first axis.

18. The device of claim 17 wherein the first axis is parallel to the X-axis and the second axis is parallel to the Y-axis.

19. The device of claim 17 wherein the first axis is parallel to the X-axis and the second axis is parallel to the Z-axis.

20. A device for hemming a flange of a panel comprising:

a carriage;

an actuator which drives the carriage between first and second positions;

a first slide carried by the carriage and slidably displaceable relative to the carriage;

a first cam having a predetermined profile;

a first follower carried by the first slide in engagement with the first cam to slidably displace the first slide relative to the carriage in response to the profile of the first cam;

a roller having an axis of rotation and pivotally carried by the first slide for angular movement of the roller axis of rotation relative to the first slide to accommodate changes in the contour of the panel whereby movement of the carriage by the actuator moves both the roller relative to the panel and the first follower relative to the first cam which controls the displacement of the first slide relative to the carriage and causes a corresponding displacement of the roller to form at least a pre-hem of a substantially continuous portion of the panels; and a second cam having a predefined profile and a second follower operably connected to the roller to control the pivotal motion of the roller in response to the profile of the second cam.

21. A device for hemming a flange of a panel comprising:

a carriage;

an actuator which drives the carriage between first and second positions;

a first slide carried by the carriage and slidably displaceable relative to then carriage;

a first cam having a predetermined profile;

a first follower carried by the first slide in engagement with the first cam to slidably displace the first slide relative to the carriage in response to the profile of the first cam;

a roller having an axis of rotation and pivotally carried the first slide for angular movement of the roller axis of rotation relative to the first slide to accommodate changes in the contour of the panel whereby movement of the carriage by the actuator moves both the roller relative to the panel and the first follower relative to the first cam which controls the displacement of the first slide relative to the carriage and causes a corresponding displacement of the roller to form at least a pre-hem of a substantially continuous portion of the panels; and a second slide carried by the first slide, slidably displaceable relative to the first slide, constructed to pivotally carry the roller and yieldably biased by a spring to force the roller into engagement with the flange.

22. A device for hemming a flange of a panel comprising:

a carriage;

an actuator that drives the carriage between first and second positions;

a first slide carried by the carriage and slidably displaceable relative to the carriage;

a first cam having a predefined profile;

a first follower carried by the first slide in engagement with the first cam and configured to slidably displace the first slide relative to the carriage in response to the profile of the first cam; and a roller supported on the first slide for pivotal motion about a pivot axis, the roller having an axis of rotation inclined relative to the pivot axis to allow the roller to follow panel contours that would otherwise be inclined relative to the roller axis of rotation, the carriage being configured to move both the roller relative to the panel and the first follower relative to the first cam thus displacing the first slide relative to the carriage and correspondingly displacing the roller to form at least a pre-hem of a generally continuous portion of the panel.

23. The device of claim 22 wherein the roller pivots about an axis generally perpendicular to its axis of rotation.

24. The device of claim 22 wherein the actuator is a manually powered mechanical device.

* * * * *